US008905114B1

(12) United States Patent
Whitaker

(10) Patent No.: US 8,905,114 B1
(45) Date of Patent: Dec. 9, 2014

(54) CORDLESS SHADE SYSTEM WITH MAGNETIC RETRACTION ELEMENTS

(76) Inventor: Julie Whitaker, Narberth, PA (US)

( * ) Notice: Subject to any disclaimer, the term of this patent is extended or adjusted under 35 U.S.C. 154(b) by 170 days.

(21) Appl. No.: 13/368,318

(22) Filed: Feb. 7, 2012

Related U.S. Application Data

(60) Provisional application No. 61/462,814, filed on Feb. 8, 2011.

(51) Int. Cl.
*E06B 9/06* (2006.01)

(52) U.S. Cl.
USPC ..... 160/84.01; 160/348; 160/DIG. 16

(58) Field of Classification Search
CPC ..... E06B 2009/2622; E06B 2009/262; E06B 9/384; E06B 9/262; E06B 9/30
USPC ..... 160/84.01, 123, 126, 348, 349.31, 160/349.2, DIG. 16
See application file for complete search history.

(56) References Cited

U.S. PATENT DOCUMENTS 4,397,346 A * 8/1983 Chumbley et al. ..... 160/84.01
7,150,304 B2 * 12/2006 Hsu ..... 160/84.01
7,195,051 B2 * 3/2007 Nien ..... 160/243
2005/0109468 A1 * 5/2005 Hsu ..... 160/84.01
2006/0086469 A1 * 4/2006 Nien ..... 160/243
2006/0207729 A1 * 9/2006 Yu et al. ..... 160/84.01
2010/0186903 A1 * 7/2010 Liang et al. ..... 160/84.01
2010/0294438 A1 * 11/2010 Kirby et al. ..... 160/84.04
2011/0146918 A1 * 6/2011 Vestal ..... 160/84.06
2011/0308745 A1 * 12/2011 Vestal et al. ..... 160/319
2012/0103539 A1 * 5/2012 Chen ..... 160/113
2012/0234502 A1 * 9/2012 Chen ..... 160/84.01

* cited by examiner

*Primary Examiner* — Katherine Mitchell
*Assistant Examiner* — Abe Massad
(74) *Attorney, Agent, or Firm* — LaMorte & Associates P.C.

(57) ABSTRACT

A cordless shade assembly having a primary panel with a face surface and a back surface. A plurality of horizontal support rods are affixed to primary panel at spaced intervals. A plurality of magnetic elements are supported by at least some of the horizontal support rods. The magnetic elements magnetically interconnect at least some of the horizontal support rods together whenever the primary panel is lifted to a raised position and at least some of the support rods come close enough together for the magnetic elements to magnetically interconnect and maintain that raised position.

5 Claims, 11 Drawing Sheets

CORDLESS SHADE SYSTEM WITH MAGNETIC RETRACTION ELEMENTS

RELATED APPLICATIONS

This application is a continuation-in-part of provisional application No. 61/462,814, entitled EcoRoman shade, filed Feb. 8, 2011.

BACKGROUND OF THE INVENTION

1. Field of the Invention

In general, the present invention relates to the structure of window shades, such as Roman shades. More particularly, the present invention relates to cordless shade retracting systems that are used to raise and lower shades to a selected height.

2. Prior Art Description

A variety of window shades exist where the panels of the shades are raised and lowered by the use of pull cords. In such prior art shades, the pull cords are attached to the various panels of the shade. The pull cords then extend up and around pulleys. As such, when the pull cords are pulled downwardly, the panels of the shades rise up.

The problem that occurs with such prior art shades is that as the pull cords are pulled down to raise the panels of the shade, the cords become longer and more exposed. Exposed pull cords then become an entanglement danger. Both children and pets have been known to become entangled and even killed in exposed pull cords. Accordingly, many shade manufacturers have attempted to reduce the danger created by pull cords.

In many prior art designs, shade manufacturers have attempted to limit the exposure of pull cords by hiding much of the length of the pull cords within the structure of the shade. The pull cords in these types of shades are housed internally. However, the pull cords extend at odd angles and actually become dangerous if the shade becomes damaged. Furthermore, such hidden cord retraction systems tend to be particularly complicated to both manufacture and operate since such retraction systems typically require the use of numerous small parts that easily malfunction. Additionally, the use of such complex cord retraction systems are difficult to adapt to complex shades, such as Roman shades that have billowing panels.

A need therefore exists for a shade retraction system that can raise and lower a shade, wherein the dangers and complexities caused by the use of internal and/or external pull cords is eliminated. A need also exists for a cordless retraction system for raising and lowering shades that can be simply and inexpensively applied to complex shade systems, such as Roman shades. These needs are met by the present invention as described and claimed below.

SUMMARY OF THE INVENTION

The present invention is a cordless shade assembly for use with Roman shades and shade systems of similar construction. The cordless shade assembly has a primary panel with a face surface and a back surface. A plurality of horizontal support rods are affixed to the primary panel at spaced intervals. Furthermore, a plurality of magnetic elements are supported by at least some of the horizontal support rods. The magnetic elements magnetically interconnect at least some of the horizontal support rods together whenever the primary panel is lifted to a raised position and at least some of the support rods come close enough together for the magnetic elements to magnetically interconnect and maintain that raised position.

In order to lower the panel, a person need only pull down on the panel with enough force to separate the support rods and separate the magnetic elements.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention shade retraction system can be embodied in many ways, the embodiments illustrated show the shade retraction system being built into the structure of Roman shades. These embodiments are selected in order to set forth the best modes contemplated for the invention. The illustrated embodiments, however, are merely exemplary and should not be considered a limitation when interpreting the scope of the appended claims.

Figure 1:
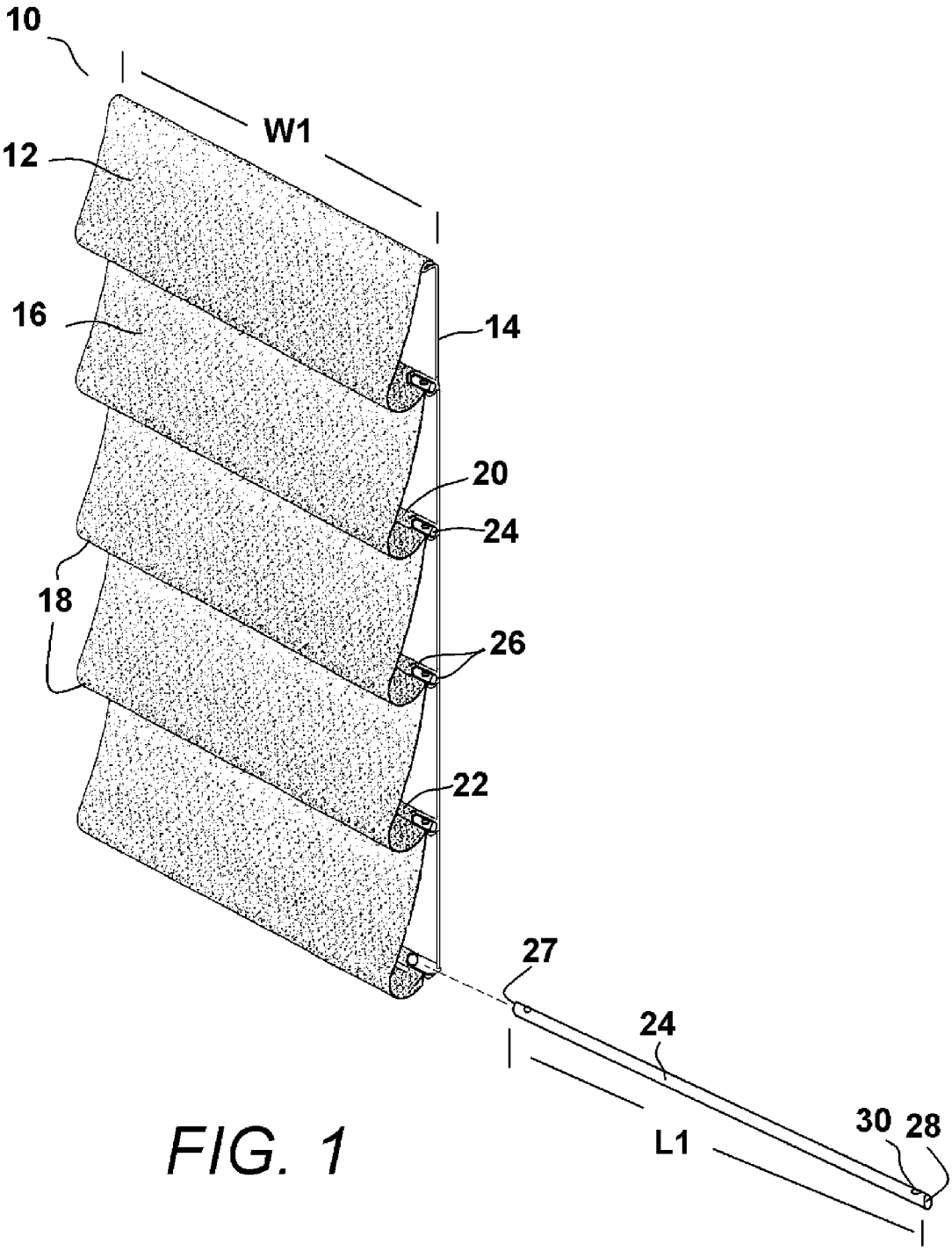
FIG. 1 is a perspective view of a first exemplary embodiment shade assembly incorporating the present invention cordless retraction system.
Figure 2:
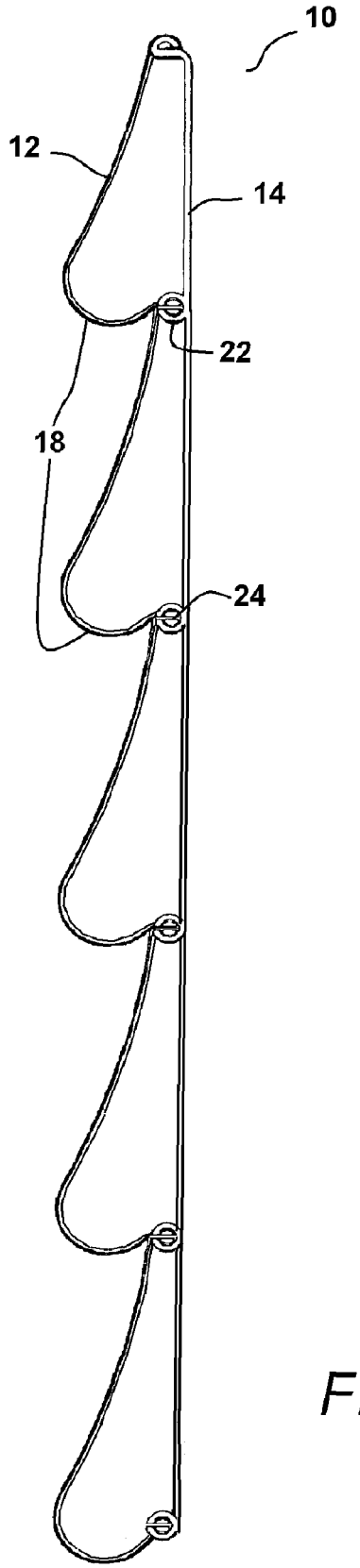
FIG. 2 is a side view of the embodiment of FIG. 1 shown in a partially raised configuration.

Referring to FIG. 1 and FIG. 2, a Roman shade assembly 10 is shown. The Roman shade assembly 10 has a primary panel 12 and a backing panel 14. Both the primary panel 12 and the backing panel 14 have a general width W1. The primary panel 12 is displayed outwardly and is typically made of patterned fabric 16. The primary panel 12 contains parallel horizontal billows 18 that are created where the primary panel 12 is folded under itself and is affixed to the backing panel 14. The points where the primary panel 12 connects to the backing panel 14 are referred to as panel attachment lines 20 for the purposes of this specification.

Tubular pockets 22 are formed along each of the panel attachment lines 20. The tubular pockets 22 can be made from a fold in the fabric 16 of the primary panel 12, or the fabric 16 of the backing panel 14, or the can be made of separate material that is sewn in place. The tubular pockets 22 have two open ends. The tubular pockets 22 can have a length that is as long as the width W1 of the primary panel 12. However, it is preferred that each tubular pocket 22 have a length that is a few inches shorter in length than the width W1 of the primary panel 12, for a purpose that will later be explained.

A plurality of support rods 24 are provided. The support rods 24 can have the same length as the width W1 of the primary panel 12. Each support rod 24 has a length L1 that is preferably smaller than the width W1 of the primary panel 12 yet is longer than the length of the tubular pockets 22. As a consequence, when the a support rod 24 is fit within a tubular pocket 22, there exist two exposed areas 26 of the support rod 24 proximate the two opposite ends 27, 28 of the support rod 24. Each support rod 24 is lightweight and sized to fit within the various tubular pockets 22. The support rods 24 are rigid and can be made from a variety of materials that are not ferro-magnetic. Support rods 24 made of wood or plastic are therefore preferred, because such material is lightweight and inexpensive, as well as being non-magnetic.

A plurality of magnetic elements 30 are provided. The magnetic elements 30 are preferably lightweight rare-earth magnets. However, iron magnets can be used. The magnetic elements 30 are attached to each of the support rods 24 proximate the ends 27, 28 of the rods 24. The magnetic elements 30 are preferably attached to the support rods 24 in the exposed areas 26 of the supports rods 24 that are not covered by the material of the tubular pockets 22. The magnetic elements 30 can be coupled to the support rods 24 in a variety of ways. However, it is preferred that a magnetic elements 30 be exposed on both the upwardly facing surface of the support rod 24 and the downwardly facing surface of the support rod 24 within each exposed area 26. Furthermore, the magnetic elements 30 that are facing upwardly and the magnetic elements 30 that are facing downwardly have opposite polarities. Positioning the magnet elements 30 in such an orientation can be achieved in a variety or ways.

Figure 3:
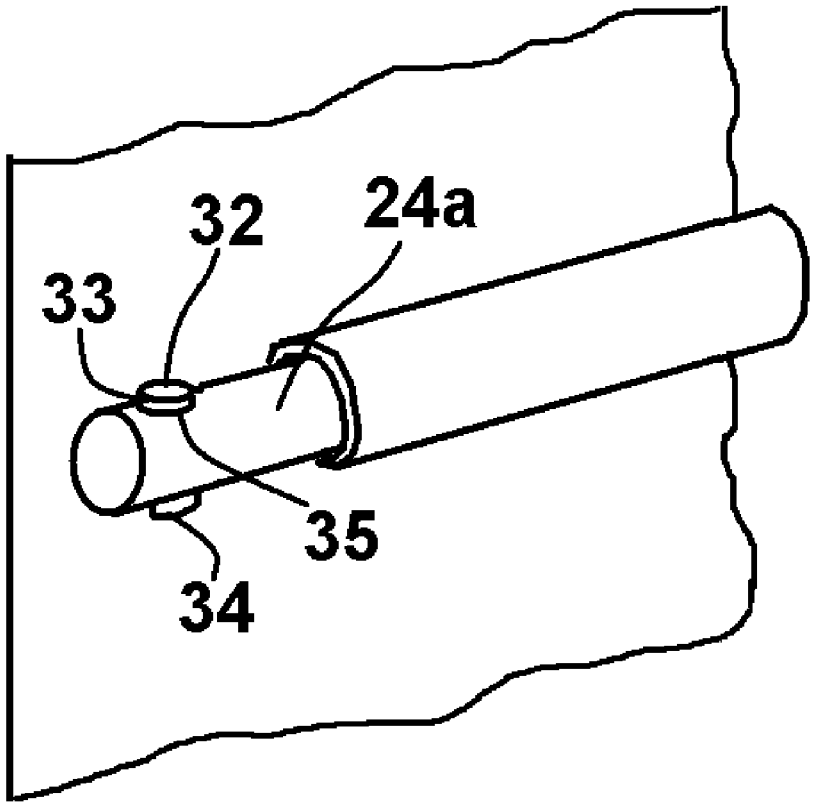
FIG. 3 is an enlarged view of one end of a first support rod with a magnetic element.

Referring briefly to FIG. 3, one such way is illustrated. In this embodiment, a cylindrical magnet 32 or a bar magnet is placed in a hole 35 drilled through the support rod 24*a*. The length of the cylindrical magnet 32 is slightly larger than the thickness of the support rod 24*a*. As a result, the ends 33, 34 of the cylindrical magnet 32 protrude above and below the support rod 24. The ends 33, 34 of the cylindrical magnet 32 have opposite polarities.

Figure 4:
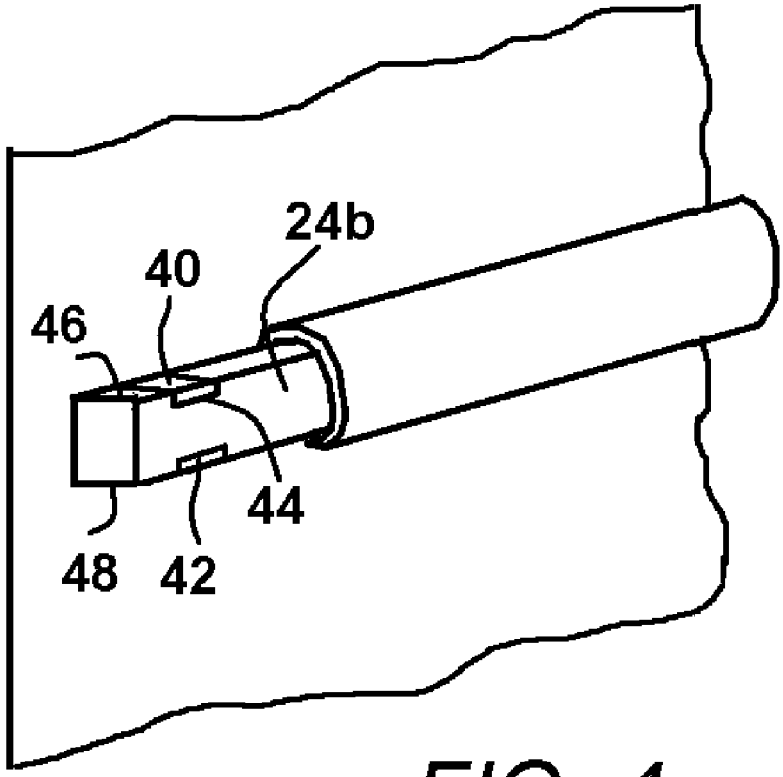
FIG. 4 is an enlarged view of one end of a second support rod with a magnetic element.

Referring to FIG. 4, an alternate embodiment is shown, wherein the support rod 24*b* has a square cross-sectional profile. Two separate magnets 40, 42 are simply glued into depressions 44 formed in the top surface 46 and the bottom surface 48 of the support rod 24*b*, respectively. The two magnets 40, 42 are oriented to present opposite polarities.

Figure 5:
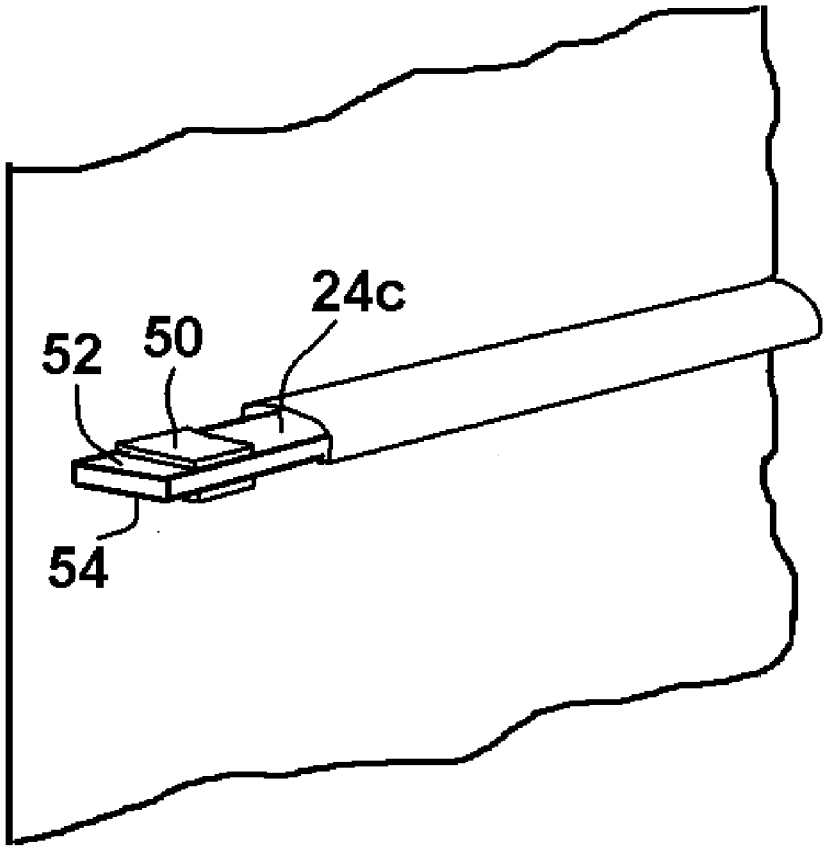
FIG. 5 is an enlarged view of one end of a third support rod with a magnetic element.

Referring to FIG. 5, an alternate embodiment is shown, wherein the support rod 24*c* has a flattened cross-sectional profile. It can be seen that flat magnets 50 can simply be adhered to the top surface 52 and the bottom surface 54 of the support rod 24*c*, wherein the flat magnets 50 are oriented to present opposite polarities.

Lastly, referring to FIG. 6, it can be seen that magnets 60 can also be attached to the ends of the support rod 24*d* as terminating finials, provided that each magnet 60 be magnetically attracted to the adjacent magnets above and below its position.

Figure 6:
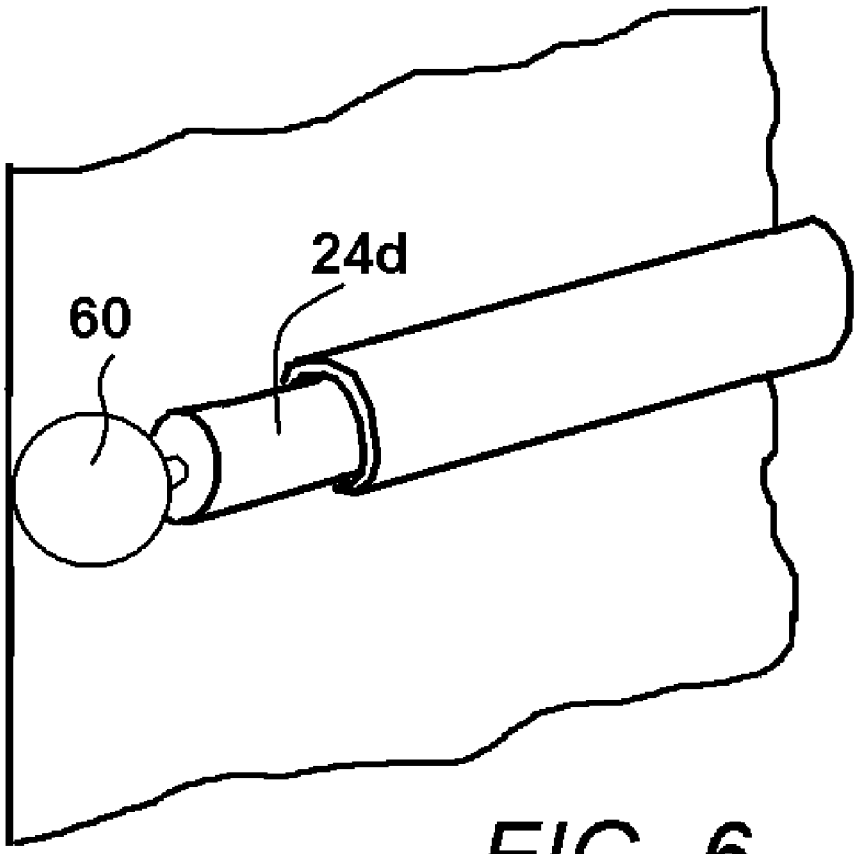
FIG. 6 is an enlarged view of one end of a fourth support rod with a magnetic element.

In the exemplary embodiments of FIGS. 4, 5, and 6, support rods 24*a*, 24*b*, 24*c*, 24*d* having different cross-sectional shapes are illustrated. This is done intentionally to show that the support rods 24 in general need only be long and straight. The cross-sectional shape of the support rods 24 is a matter of design choice and a matter of what works best aesthetically with the overall design of the Roman shade assembly 10.

Figure 7:
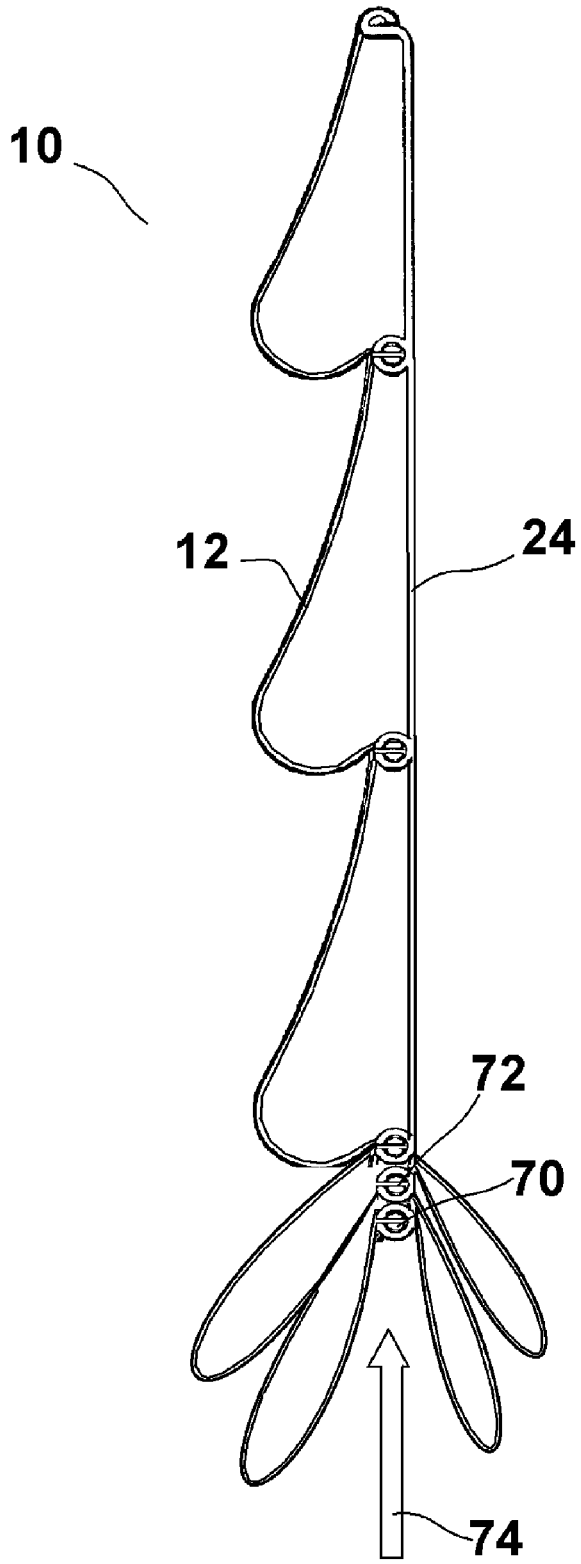
FIG. 7 is a perspective view of the first exemplary embodiment shade assembly of FIGS. 1 and 2 shown in a partially drawn configuration.

Referring now to FIG. 7 in conjunction with both FIG. 1 and FIG. 2, it can be seen that the support rods 24 include a base support rod 70 that is used at the bottom of the primary panel 12. The base support rod 70 is the last of the support rods 24 in the Roman shade assembly 10. In order to draw the Roman shade assembly 10 open, the base support rod 70 is manually lifted up in the vertical direction until the base support rod 70 contacts the next adjacent support rod 72. This is accomplished by simply placing a hand under the primary panel 12 and lifting the primary panel 12 vertically upward in the direction of arrow 74. As the base support rod 70 contacts the next adjacent support rod 72, the magnetic elements 30 on the support rods 70, 72 magnetically interconnect. This retains the Roman shade assembly 10 in its open configuration. The Roman shade assembly 10 can be opened to any degree depending upon how many support rods 24 are pushed upwardly into contact with others of the support rods 24. In order to fully open the Roman shade assembly 10, all of the support rods 24 within the Roman shade assembly 10 are magnetically interconnected.

The use of the magnet elements 30 in the exposed areas 26 of the support rods 24 help the support rods 24 to magnetically interconnect without any intervening material. The magnetic elements 30 can be covered by the fabric of the tubular pockets 22. However, depending upon the thickness of the fabric being used, stronger magnetic elements 30 may have to be used to maintain magnetic connections through the bulk of the fabric.

In order to close the Roman shade assembly 10, the primary panel 12 is simply pulled down to the desired degree of closure. The force used to pull down the primary panel 12 needs to be greater than that of the magnetic connection force between support rods 24. As the primary panel 12 is pulled down, the support rods 24 are pulled apart and the magnet elements 30 on the various rods 24 no longer interconnect.

Figure 8:
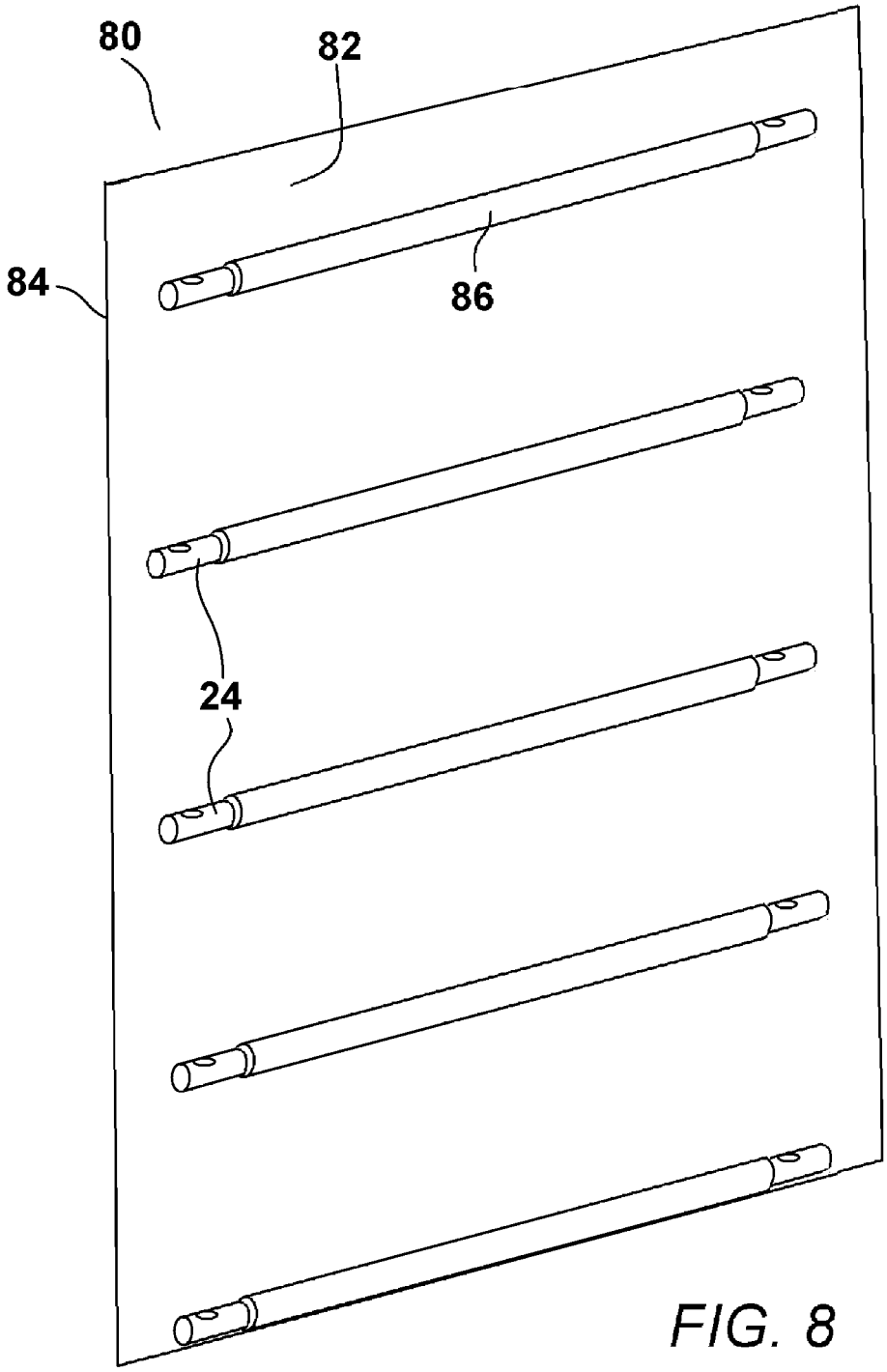
FIG. 8 is a perspective view of a second exemplary embodiment of a shade assembly in an extended condition.
Figure 9:
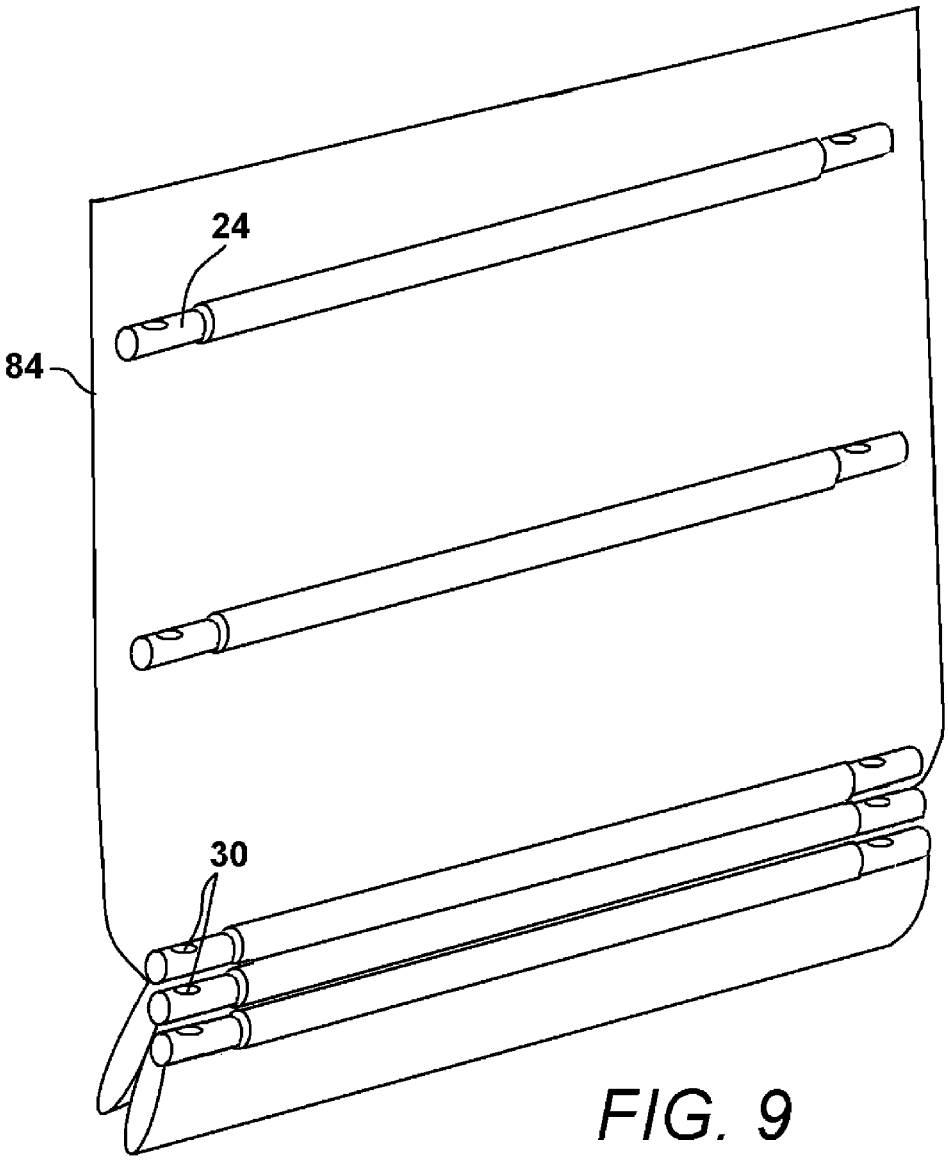
FIG. 9 is a perspective view of the second exemplary embodiment of FIG. 8 shown in a partially drawn configuration.

In the embodiments thus shown, a Roman shade assembly 10 is provided having a primary panel 12 and a backing panel 14. The support rods 24 are mostly hidden within tubular pockets 22 between the primary panel 12 and the backing panel 14. Referring to FIG. 8, a second exemplary embodiment is shown of a simplified Roman shade assembly 80. In the embodiment of FIG. 8, a Roman shade assembly 80 is shown that does not have a back panel. Rather, the Roman shade assembly 80 has a simple one panel design. In this embodiment, tubular pockets 86 are formed on the rear surface 82 of the panel 84. The tubular pockets 86 hold support rods 24 of the types previously described. Referring to FIG. 9 in conjunction with FIG. 8, it can be seen that the Roman shade assembly 80 can be shortened to any desired length simply by lifting the bottom of the panel 84 to a desired height. The magnets 30 on the support rods 24 displaced by the lifting action magnetically interconnect and retain the panel 84 at its lifted height.

Figure 10:
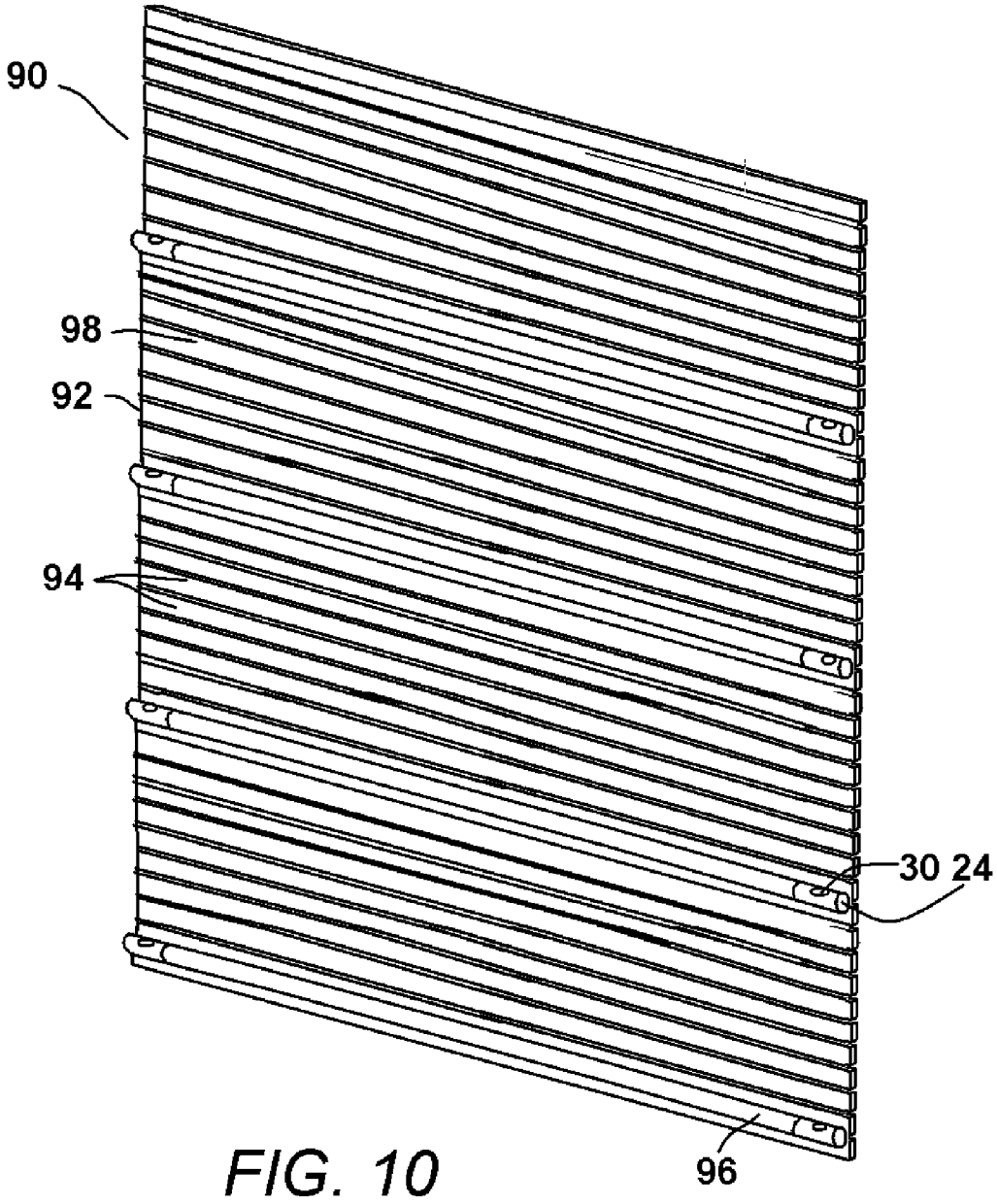
FIG. 10 is a perspective view of a third exemplary embodiment of a shade assembly in an extended condition.
Figure 11:
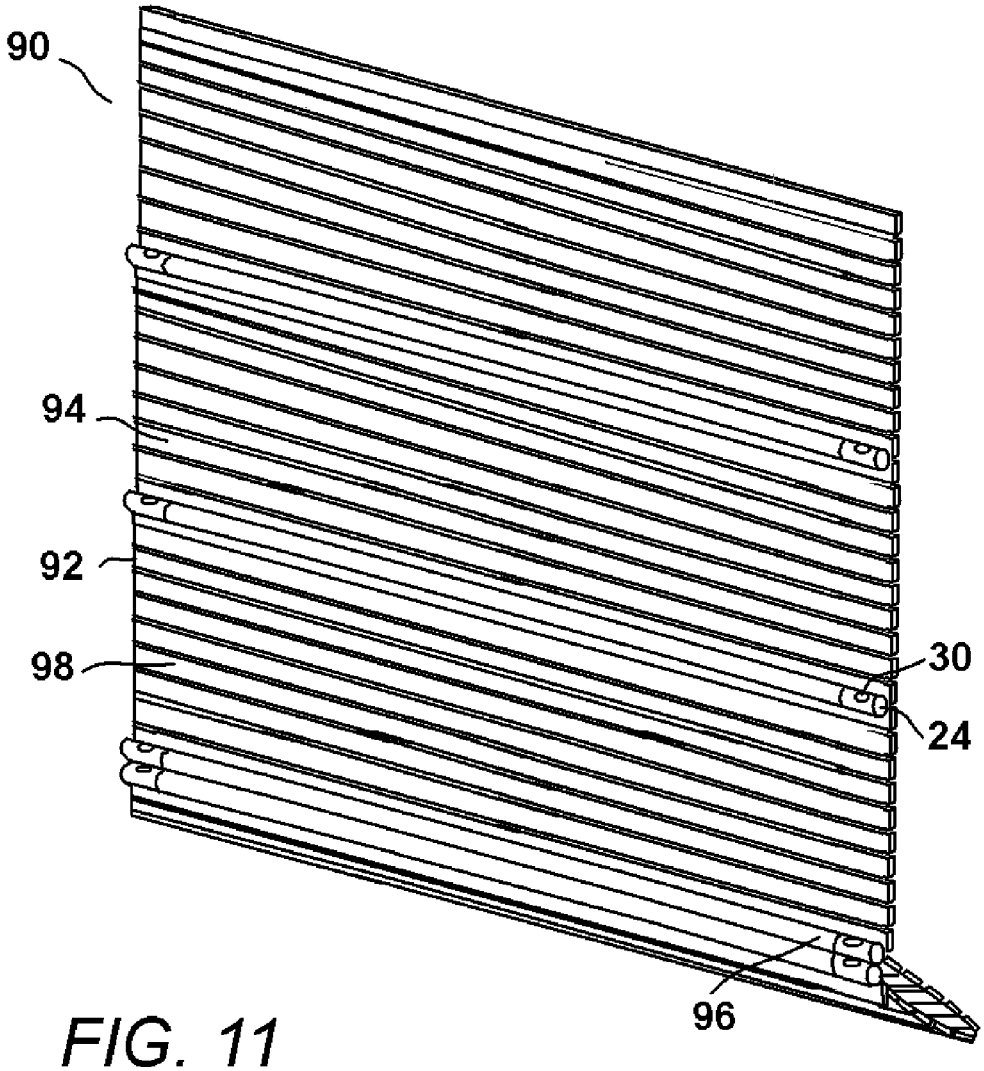
FIG. 11 is a perspective view of the embodiment of FIG. 10 shown in a partially drawn configuration.

Referring lastly to both FIG. 10 and FIG. 11, a third exemplary embodiment is shown of a simplified Roman shade assembly 90 is shown. In this embodiment, the Roman shade assembly 90 has a single shade panel 92 that is not made of fabric. Rather, the shade panel 92 is made of interconnected slats 94. The slats can be plastic, wood, bamboo or the like. However, together, the slats 94 form a single shade panel 92. In this embodiment, tubular pockets 96 are formed on the front surface 98 of the shade panel 92. The tubular pockets 98 hold support rods 24 of the types previously described. Referring to FIG. 11 in conjunction with FIG. 10, it can be seen that the Roman shade assembly 90 can be shortened to any desired length simply by lifting the bottom of the shade panel 92 to a desired height. The magnets 30 on the support rods 24 displaced by the lifting action magnetically interconnect and retain the shade panel 92 at its lifted height.

It will be understood that the embodiments of the present invention that are illustrated and described are merely exemplary and that a person skilled in the art can make many variations to those embodiments. All such embodiments are intended to be included within the scope of the present invention as defined by the claims.

What is claimed is:

1. A shade assembly, comprising:

a primary panel having a face surface and a back surface of a first width;

a plurality of tubular pockets affixed to said primary panel along spaced, parallel lines, wherein each of said tubular pockets has a first open end, a second open end, and a first length that extends between said first open end and said second open end, wherein said first length is shorter than said first width of said primary panel;

a plurality of horizontal support rods that extend through said plurality of tubular pockets, wherein each of said horizontal support rods has a first end, a second end and a second length that extends between said first end and said second end, wherein said second length is longer than said first length of each of said tubular pockets, therein leaving exposed areas on each of said horizontal support rods, said exposed areas extending from said first open end of each of said tubular pockets to said first end of each of said horizontal support rods, and extending from said second open end of each of said tubular pockets to said second end of each of said horizontal support rods, wherein said second length of each of said horizontal support rods is shorter than said first width of said primary panel; and a plurality of magnetic elements supported by said at least some of said horizontal support rods within said exposed areas, wherein said magnetic elements magnetically interconnect at least some of said horizontal support rods together when said primary panel is lifted to a raised position and at least some of said support rods come close enough together for said plurality of magnetic elements to magnetically interconnect and maintain said raised position.

2. The shade assembly according to claim 1, wherein said second length of each of said horizontal support rods is the same.

3. The shade assembly according to claim 1, further including a back panel coupled to said primary panel proximate said parallel lines.

4. A shade assembly, comprising:

a primary panel having a face surface and a back surface of a first width;

a secondary panel affixed to said primary panel along a plurality of parallel panel attachment lines;

a plurality of tubular pockets disposed along said panel attachment lines, wherein each of said tubular pockets has a first open end, a second open end, and a first length that extends between said first open end and said second open end, wherein said first length is shorter than said first width of said primary panel;

a plurality of support rods that extend through said tubular pockets, wherein each of said support rods has a first end, a second end and a second length that extends between said first end and said second end, wherein said second length is longer than said first length of each of said tubular pockets, therein leaving exposed areas on each of said support rods, said exposed areas extending from said first open end of each of said tubular pockets to said first end of each of said support rods, and extending from said second open end of each of said tubular pockets to said second end of each of said support rods, wherein said second length of each of said horizontal support rods is shorter than said first width of said primary panel;

a plurality of magnetic elements supported by said support rods within said exposed areas, wherein said magnetic elements magnetically interconnect said support rods together when said panel is lifted to a raised position and at least one of said support rods is brought close enough to another of said support rods for said plurality of magnetic elements to magnetically interconnect and maintain said raised position.

5. The shade assembly according to claim 1, wherein each of said support rods is non-magnetic.

* * * * *